US005692574A

United States Patent [19]

Terada

[11] Patent Number: 5,692,574

[45] Date of Patent: Dec. 2, 1997

[54] VIBRATING TOOL AND A VIBRATION ISOLATING RING

[75] Inventor: Yuichi Terada, Aichi, Japan

[73] Assignee: Makita Corporation, Aichi, Japan

[21] Appl. No.: 492,436

[22] Filed: Jun. 19, 1995

[30] Foreign Application Priority Data

Jul. 12, 1994 [JP] Japan ..... 6-160067

[51] Int. Cl.[6] ..... B25D 17/00; B27B 17/02

[52] U.S. Cl. ..... 173/162.2

[58] Field of Search ..... 173/162.1, 162.2, 173/210, 211

[56] References Cited

U.S. PATENT DOCUMENTS

| | | | |
|---|---|---|---|
| 3,637,029 | 1/1972 | Sherwood, Jr. et al. | 173/162.2 |
| 3,845,557 | 11/1974 | Bailey | 173/162.2 |
| 4,401,167 | 8/1983 | Sekizawa et al. | 173/162.1 |
| 4,800,965 | 1/1989 | Keller | 173/162.2 |

FOREIGN PATENT DOCUMENTS

| | | |
|---|---|---|
| 54-1446 | 1/1979 | Japan . |
| 62-46485 | 12/1987 | Japan . |

*Primary Examiner*—Scott A. Smith

*Attorney, Agent, or Firm*—Davis and Bujold

[57] ABSTRACT

In a vibrating tool, a body housing and a handle are displaceably interconnected and a large range of vibrations can be effectively absorbed. A vibrating tool is composed of a body housing and a handle. A projection is provided at the rear end of the body housing. By engaging a stop on the handle with a flange on the projection, the handle is positively interconnected with the housing with a clearance therebetween. A rubber ring is located in the clearance between the handle and the body housing. A radially inwardly opening groove is provided in the rubber ring, so that the ring is easily deformed when the handle and the body housing are displaced relative to each other. Since the handle and the body housing are displaceably interconnected with each other and the rubber ring interposed between the handle and the body housing is easily deformed, large amplitude vibrations can be absorbed. The inwardly opening groove is sealed by the outer periphery of the projection of the housing, thereby providing an air cushion effect for absorbing high frequency vibrations.

19 Claims, 6 Drawing Sheets

VIBRATING TOOL AND A VIBRATION ISOLATING RING

FIELD OF THE INVENTION

This invention relates to a vibrating tool having a vibration isolating ring, for isolating the handle from vibration generated by the vibrating tool.

BACKGROUND OF THE INVENTION

Known vibration isolating measures for vibrating tools are described in Examined and Published Japanese Utility Model Application Nos. 54-1446 and 62-46485.

The vibrating tool of the Examined and Published Japanese Utility Model Application No. 54-1446 (hereinunder referred to as the first reference example) is, as shown in FIGS. 5A and 5B, provided With projections 103 at the rear end of a tool body 101. Bar-shaped elastic members 105 are engaged in through holes in the projections 103 and are held between a pair of handle members 107 and 108. In this structure, the elastic members 105 are deformed under shearing forces, thereby absorbing vibration of the vibrating tool.

The vibrating tool described in the Examined and Published Japanese Utility Model Application No. 62-46485 (hereinunder referred to as the second reference example) is, as shown in FIGS. 6A, 6B and 6C, provided with a projection 113 at the rear end of a tool body 111. A hollow rubber cylindrical member 115 is engaged in a through hole in the projection 113 and is held between a pair of handle members 117 and 118, such that parts 119, 120, which are integrally projected from the handle members 117, 118, respectively, are inserted into the ends of the hollow cylindrical member 115. The tool body 111 is fastened together with the handle members 117, 118 by a screw. Further, a rubber ring 123 is attached to a root 121 of the projection 113. By fastening together the handle members 117, 118 and the tool body 111 with the rubber cylindrical member 115 and the rubber ring 123 held in the tool body 111, vibration is absorbed.

In the first reference example, however, the tool body 101 is securely connected with the handle members 107, 108 only by the bar-shaped elastic member 105. When large amplitude vibrations or impacts are applied to the vibrating tool, a relatively large shearing force is concentrated on the elastic members 105. The large shear forces will eventually break the elastic members 105. Since the only connection between the handle members 107, 108 and the tool body 101 is provided by the elastic members 105, when the elastic members 105 break, the tool body 101 falls off the handle members 107, 108. If the member 105 is hardened so as to bear the shearing force, however, the vibration is insufficiently isolated. Also, the handle members 107 and 108 must be made deep enough to provide sufficient space for receiving the elastic members 105.

In the second reference example, rubber components 115, 123 are interposed as packing or lining members in the clearance between the tool body 111 and the pair of handle members 117,118. The handle members 117, 118 are relatively fixedly connected with the tool body 111. Therefore, the elastic components 115, 123 are insufficiently axially displaced, deflected or deformed, to effectively absorb the vibration. The vibration isolating performance of the individual components is not effectively utilized.

SUMMARY OF THE INVENTION

Wherefore, an object of the invention is to provide a vibrating tool in which a tool body housing and a handle are displaceably interconnected with each other in a manner such that large amplitude vibrations are sufficiently absorbed.

A further object of the invention is to provide a vibration isolating ring for use in a vibrating tool.

To attain these or other objects, the invention provides a vibrating tool composed of a body housing for housing a drive part with a vibrating mechanism incorporated therein and a handle. The body housing and the handle are separately formed, but are interconnectedly assembled for use. The body housing is provided with a projection to be engaged into the handle. The handle is composed of two handle members for holding the projection of the body housing therebetween. The projection is engaged in the handle with a clearance therebetween, such that the body housing and the handle can move relative to each other, at least in vibrating direction. The handle is not fixedly secured to the body housing, but is interconnected with the housing in a manner that prevents the handle from disengaging from the body housing. Further, an elastically compressible member is interposed between the handle and the body housing for absorbing vibration.

In the vibrating tool according to the invention, the handle engages a projection of the body housing, which prevents the handle from separating from or falling off the body housing. The elastically compressible member is interposed and deformed between the handle and the body housing, thereby absorbing vibration.

In the reference examples the body housing and the handle are fastened together with rubber components or other elastic packing or lining components held therebetween. The vibration isolation results only from the physical property, vibration attenuating action, of the rubber or other elastic materials. The reference examples form a relatively immobile connection between the body housing and the handle. By filling the joint between the body housing and the handle with rubber or other elastic material, the vibration is physically absorbed by the material. Different from the reference examples, the body housing and the handle in the present invention are engaged with each other such that they are displaceable relative to each other. The mechanical deformation of the elastically compressible member isolates the handle from the vibration of the body housing. Therefore, different from the reference examples, in which the elastic member requires some degree of hardness, the elastic member of the invention can be relatively soft and absorb much more vibration more efficiently.

Further in the invention, for interconnecting or engaging the handle and the body housing, the projection of the body housing is provided with a radially extending flange at the end thereof and the handle is provided with a stop for engaging the flange. By engaging the flange on the body housing the stop prevents the body housing and the handle from completely separating from each other, while allowing relative movement, at least in vibrating direction. The elastically compressible member can be an annular component to be attached around the projection of the body housing, between the body housing and the flange.

Separation of the handle from the body housing is prevented by the engagement of the stop on the handle with the flange on the projection of the body housing. At the same time, the body housing and the handle can be relatively displaced at least in vibrating direction. Alternatively, by passing a retaining pin or other retaining member through an elongate slot made in the projection of the body housing, for example, the body housing and the handle can be slidably interconnected with each other. A tool having a tool body housing with a flange and a handle with a stop, however, is easier to assemble than a tool having a retaining pin passed through an elongate slot in the projection.

In the vibrating tool according to the invention, the elastically compressible member can be provided with an outwardly opening annular groove, which is engaged with the stop on the handle. When the stop is integrally engaged with the elastically compressible member, the compressible member provides cushioning for absorbing the twisting vibrations and forces exerted in directions other than the vibrating direction. Therefore, the vibration isolating effect is enhanced.

The cross section of the portion of the elastically compressible member, that is held between the handle and the body housing is preferably formed partially open or hollow, or in another deformable configuration. With this construction, when the handle and the body housing are approaching each other, the elastically compressible member easily deforms, and can thereby absorb relatively large amplitude vibrations. When the cross section is hollow, air enclosed in a hollow acts as an air cushion. The air cushion effectively attenuates high frequency vibrations.

When the part, held between the handle and the body housing, of the elastically compressible member is provided with an inwardly opening annular groove, the opening in the annular groove is sealed by the outer periphery of the projection of the body housing. Thus, the elastically compressible member having such a configuration, also acts as an air cushion for absorbing high frequency vibrations. As a result, large amplitude vibrations, as well as high frequency vibrations, are effectively absorbed. Thus, a wide-range vibration isolating effect is provided.

The invention further provides a vibration isolating ring being formed of elastic material and having an inwardly opening annular groove. By mounting the vibration isolating ring around the extension of the body housing of a vibrating tool, the inwardly opening annular groove is deformed upon vibration of the tool, thereby effectively absorbing vibration. The inward opening in the groove is sealed by the outer periphery of the extension around which the vibration isolating ring is mounted. Therefore, as aforementioned, an air cushion effect is provided. Even when the vibration isolating ring is used as a replacement component of the elastically compressible member of the vibrating tool or even when it is attached to a tool other than the vibrating tool, it can effectively absorb a wide-range of vibrations.

The vibration isolating ring may also be provided with an outwardly opening annular groove. The stop on the handle is engaged and gripped in the outwardly opening annular groove. Therefore, vibration exerted in a twisting direction is also absorbed.

As aforementioned, in the invention, the vibration isolating efficiency of vibrating tools is increased by the present invention. Since frequent, large amplitude and high energy vibrations can be effectively absorbed, little vibration is transmitted to a vibrating-tool user or worker. Consequently, the worker is protected from fatigue, even when operating the vibrating tool for a long time, and workability is increased.

The vibration isolating elastic member of the invention can easily be assembled onto the vibrating tool. Even when the elastic member deteriorates as time lapses, the handle will not separate from or fall off the body housing of the vibrating tool. Moreover, when the worker carelessly drops the vibrating tool, the resulting shock is absorbed and the handle or other components are protected from breakage.

BRIEF DESCRIPTION OF THE DRAWINGS

The invention will now be described, by way of example, with reference to the drawings, in which.

DETAILED DESCRIPTION OF THE PREFERRED EMBODIMENTS

Figure 1A:
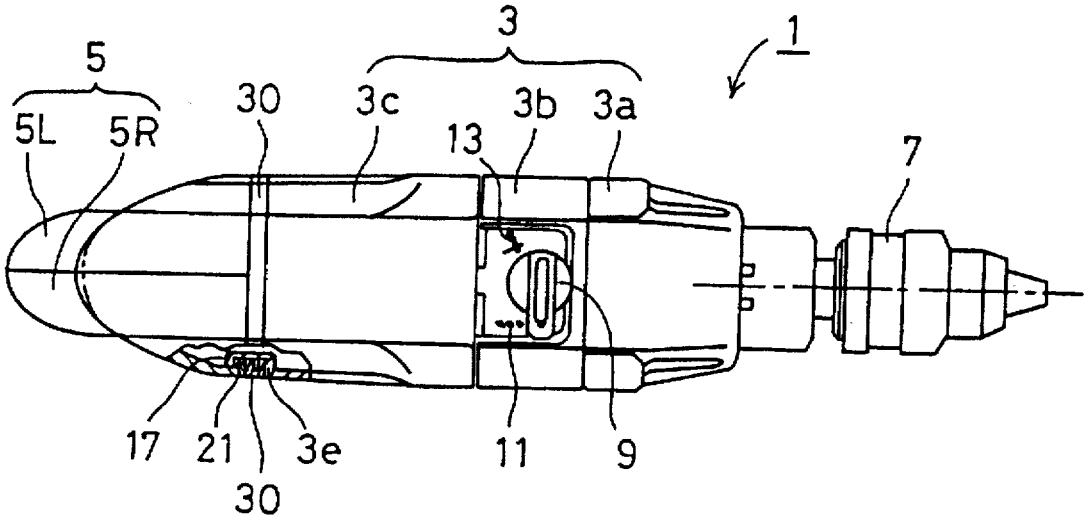
FIG. 1A is a top plan view, partially broken away, showing a vibrating drill according to a first embodiment of the invention.

In a first embodiment, as shown in FIG. 1A, a vibrating drill 1, suitable for making holes in blocks, tiles and bricks, is composed of a body housing 3, for housing a drive part with a vibrating mechanism incorporated therein, displaceably interconnected with a hand-held handle 5. A chuck 7, by which a drill part is rotatably held, projects from the fore end of the body housing 3. When a change lever 9 is turned to a drill mark 11, the chuck 7 is only rotated, and when the lever 9 is turned to a hammer drill mark 13, the chuck 7 is both rotated and vibrated.

Figure 1B:
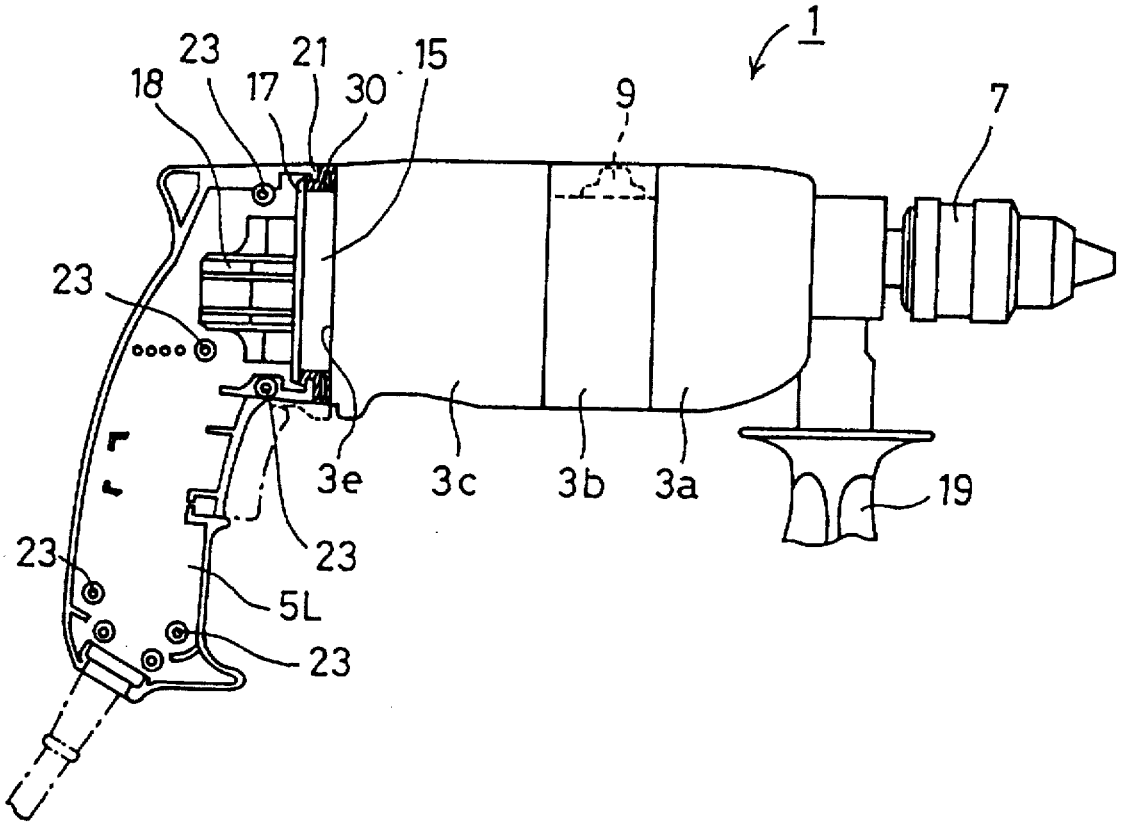
FIG. 1B is a side view showing the vibrating drill of FIG. 1A with a front handle member being omitted in FIG. 1A.

The body housing 3 is composed of a synthetic resin covering in which an armature, a cam, a gear, a bearing and other known vibrating drill components are housed. The body housing 3 is formed by integrally assembling together three body sections 3*a*, 3*b*, 3*c*. Further, a cylindrical projection 15, having a smaller diameter than that of the body sections, is projected from the rear end of the rearmost body section 3*c*. A flange 17, having a larger diameter than that of the projection 15, extends radially outwardly from the rear end of the projection 15. A bearing support part 18 of the rear end of the armature is integrally formed with the rearmost body section 3*c*. Further, as shown in FIG. 1B, the vibrating drill 1 is provided with a hand grip 19. When operating the vibrating drill 1, the handle 5 is held by one hand and the hand grip 19 is gripped with the other hand, the vibrating drill 1 is securely manually supported.

The handle 5 is a synthetic resin assembly of vertically aligned handle members 5L and 5R. The fore end of the handle 5 is provided with a radially inwardly extending annular stop 21, which defines an annular recess for receiving said flange 17. The vibrating drill 1 is assembled by inserting the stop 21 into the annular space defined between the rear end wall 31*e* of the body housing and the flange 17, such that the tip of the stop 21 does not contact the outer periphery of the projection 15 and the outer peripheral edge of the flange 17 received in the annular recess in said handle, but does not contact the inner wall of the handle 5.

With the above construction, the handle 5 is positively connected or engaged with the body housing 3, in a manner that engagement of the stop 21 on the handle with the flange 17 on the projection 15 prevents the handle 5 from falling off the body housing 3, simply by assembling them such that the projection 15 of the body housing 3 is held between the handle members 5L and 5R and the stop 21 engages the flange 17. Furthermore, a clearance is provided between the handle 5 and the body housing 3, such that they can be displaced in the vibrating, rotating, twisting or any other direction. The handle members 5L and 5R are fastened together by passing screws through screw holes 23, as shown in FIG. 1B.

Figure 2C:
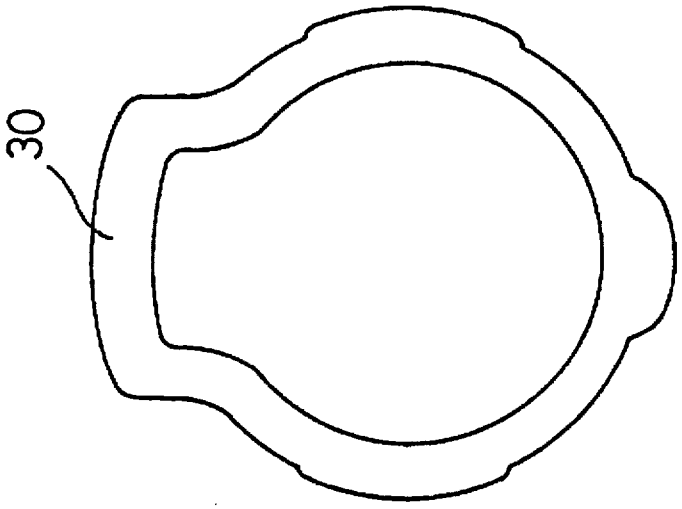
FIG. 2C is a rear view of the ring.
Figure 2B:
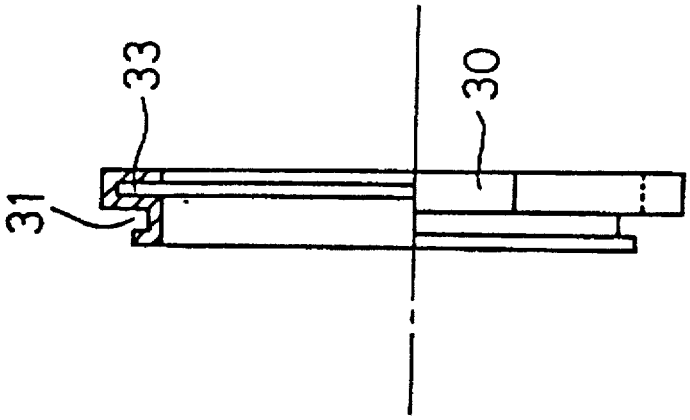
FIG. 2B is a side view, partially broken away, of the ring.
Figure 2A:
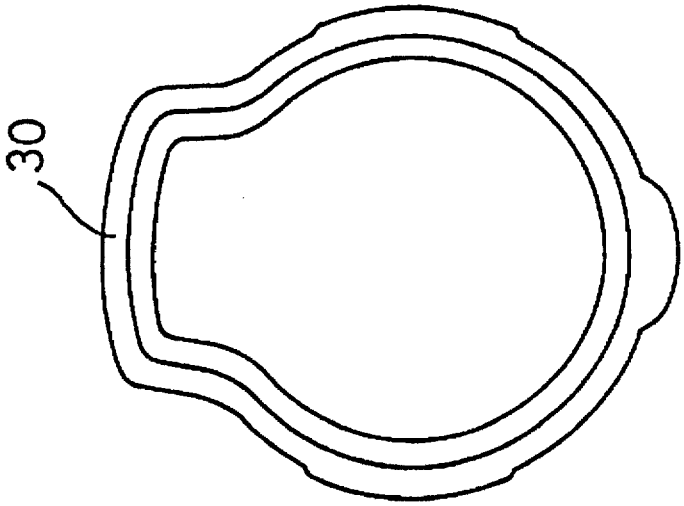
FIG. 2A is a front view of a rubber ring according to the first embodiment of the invention.
Figure 3A:
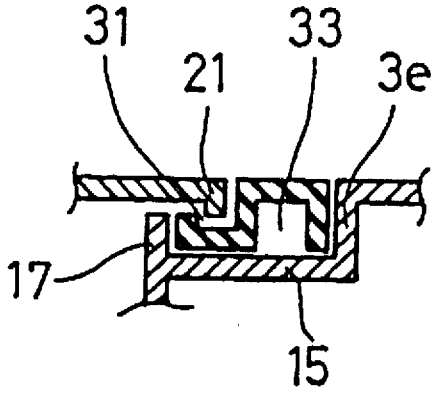
FIG. 3A shows the relative displacement between a body housing and a handle when moving away from each other according to the first embodiment of the invention.

A rubber ring 30 is provided in the clearance provided between the handle 5 and the body housing 3. As shown in FIGS. 2A, 2B and 2C, the rubber ring 30 has an irregularly formed cross section. As shown in the longitudinal cross-sectional view of FIG. 2B, the rear end of the rubber ring 30 defines a radially outwardly opening groove 31 having a square cross section, and the fore end of the rubber ring 30 defines a radially inwardly opening groove 33 having a square cross section. The outwardly opening groove 31 is wide enough for the stop 21 of the handle 5 to be engaged in and gripped by the groove 31. As shown in FIGS. 1A, 1B and 3A, the rubber ring 30 is sufficiently thick in the longitudinal direction such that the ring 30 fits in and fills the space defined between the rear end wall **3*e* of the body housing 3 and the flange 17 of the projection 15. The inner diameter of the rubber ring 30 is slightly smaller than the outer diameter of the projection 15 of the body housing 3. When the rubber ring 30 is mounted around the projection 15 of the body housing 3, the inner wall of the rubber ring 30 tightly abuts on the outer periphery of the projection 15. Thus, the inwardly opening groove 33 is sealed by the outer periphery of the projection 15**.

Figure 3B:
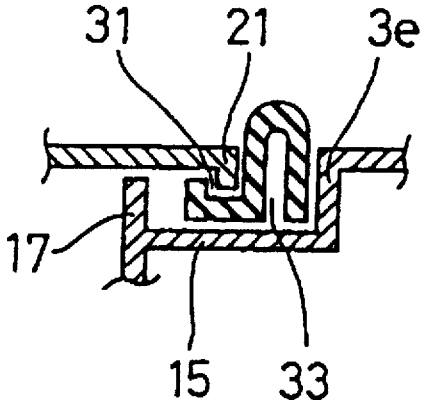
FIG. 3B shows relative displacement between the body housing and the handle when approaching each other.

The vibration isolating effect in the vibrating drill 1 of the embodiment will now be explained referring to FIGS. 3A and 3B. In FIGS. 3A and 3B, a slight clearance is shown between the rubber ring 30 and the rear end wall **3*e* of the body housing 3, the projection 15, the flange 17 and the stop 21 of the handle 5. The clearance is shown just for convenience of illustration. The rubber ring 30** actually closely abuts on the components. The same applies to FIGS. 4A–4F.

As shown in FIG. 3B, when the body housing 3 and the handle 5 are approaching each other, the radially inwardly opening groove 33 of the rubber ring 30 is deformed, thereby absorbing vibration of the body housing 3. The rubber ring 30 can be largely deformed because the body housing 3 is displaceably connected or engaged with the handle 5, and is prevented from becoming disengaged from the handle 5. Therefore, the displacement of the body housing 3 relative to the handle caused by vibration is substantially unrestricted. The vibration is absorbed mechanically and structurally when the rubber ring 30 is deformed. Consequently, large amplitude vibration can be absorbed.

The radially inward opening groove 33 is sealed by the outer periphery of the projection 15. Therefore, when the groove 33 is deformed as shown in FIG. 3B, air in the interior of the groove 33 is prevented from leaking outside and provides an air cushion effect. Consequently, high frequency vibrations can also be effectively absorbed.

As aforementioned, in the vibrating drill 1 of the first embodiment, the body housing 3 is displaceably connected with the handle 5. Vibrations are absorbed by the rubber ring 30, which can be largely and positively deformed and also acts as an air cushion. Consequently, strong, large amplitude vibrations as well as weak high frequency vibrations can be absorbed. Since a wide-range of vibrations are effectively absorbed, virtually no vibration is transmitted from the body housing 3 to the handle 5.

Also in the first embodiment, the stop 21 of the handle 5 is gripped by the radially outwardly opening groove 31 of the rubber ring 30, which restricts the displacement of the handle 5 in rotating direction. Therefore, relative twisting vibration of the handle is also prevented.

In the first embodiment, the body housing 3 and the handle 5 are interconnected without using retaining pins or other fastening members, which facilitates assembly of the vibrating drill 1. Different from the first reference example, no space for receiving the elastic members 105 is required between the handle. Therefore, the handle 5 does not have to be as large in size.

This invention has been described above with reference to the preferred embodiment as shown in the figures. Modifications and alterations may become apparent to one skilled in the art upon reading and understanding the specification. Despite the use of the first embodiment for illustration purposes, the invention is intended to include all such modifications and alterations within the spirit and scope of the appended claims.

Figure 4A:
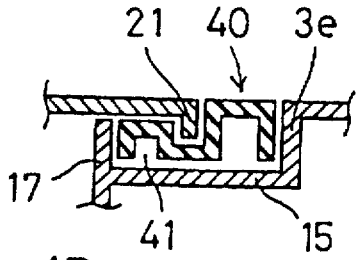
FIGS. 4A, 4B, 4C, 4D, 4E, 4F, 4G, 4H, 4I, 4J and 4K are cross-sectional views of modified vibration isolation mechanisms according to the invention.

For example, as shown in FIG. 4A, a modified rubber ring 40 is provided with an additional radially inwardly opening groove 41 to be interposed between the stop 21 and the flange 17. When the body housing 3 and the handle 5 move away from each other, the rubber ring 40 is deformed and the air sealed in groove 41 acts as air cushion. In this rather complicated structure, the vibration isolating effect is thus further enhanced.

Figure 4B:
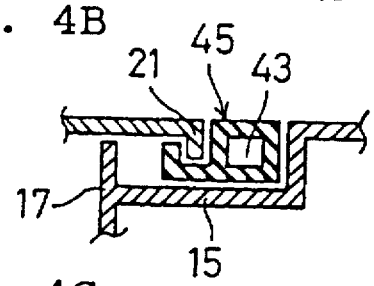

In another modified rubber ring 45 shown in FIG. 4B, the radially inwardly opening groove 33 of the first embodiment is replaced with a hollow part 43, thereby providing an enhanced air cushion effect. Especially, fine high frequency vibrations are more effectively absorbed. However, large amplitude vibrations are more effectively absorbed by the rubber ring 30 of the first embodiment, as compared with the modified rubber ring 45.

Figure 4C:
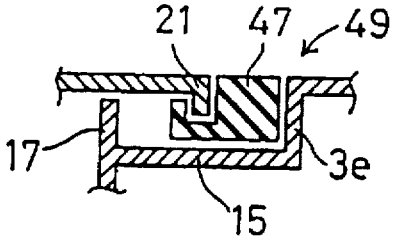

As shown in FIG. 4C, another modified rubber ring 49 is provided with a solid block 47 to be interposed between the rear end wall **3*e* of the body housing 3 and the stop 21 of the handle 5. The rubber ring 49 is inferior to the rubber ring 30 of the first embodiment when absorbing large amplitude vibrations. If the rubber ring 49** is made of sponge rubber or other very soft elastic material, however, such inferiority can be improved to some degree. In the invention, the body housing and handle are positively connected with each other. The vibration isolating elastic member does not have to fasten the body housing and the handle together, and can therefore be formed of a relatively soft elastic material such as sponge rubber.

Figure 4D:
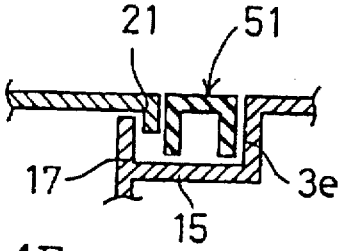
Figure 4E:
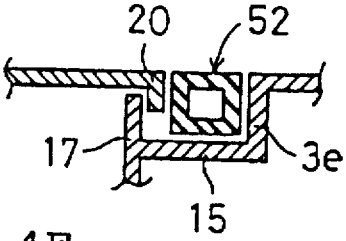
Figure 4F:
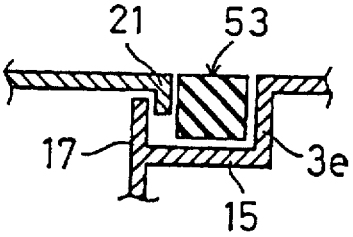

In the modifications shown in FIGS. 4A, 4B and 4C, the rubber rings 40, 45, 49 are, respectively, provided with radially outwardly opening grooves in which the stop 21 of the handle 5 is gripped. Alternatively, as shown in FIGS. 4D, 4E and 4F, rubber rings 51, 52 and 53 having no such radially outwardly opening grooves can be used.

Figure 4G:
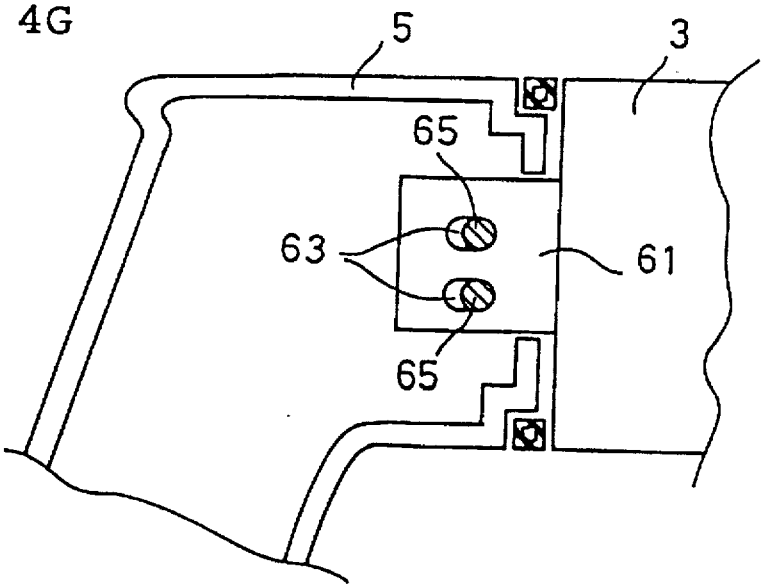

As shown in FIG. 4G, the handle 5 and the body housing 3 can be displaceably connected by passing retaining pins 65, secured or connected to the handle, through elongate slots 63 made in a rear end projection 61 of the body housing 3. By interconnecting the handle 5 and the body housing 3 in this way, they can be displaced in the vibrating direction.

Figure 4H:
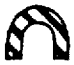
Figure 4I:
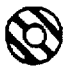
Figure 4J:
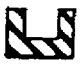
Figure 4K:
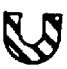
Figure 5A:
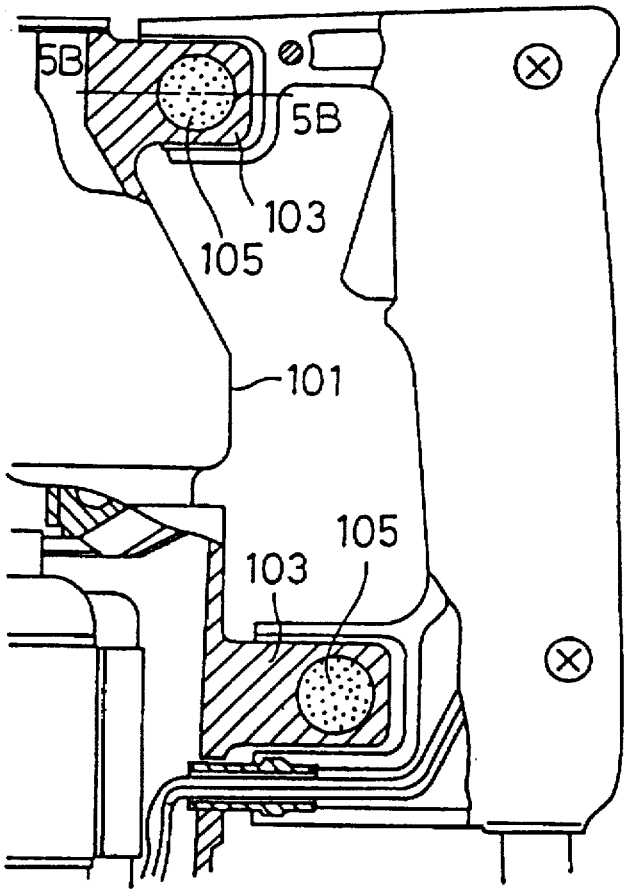
FIG. 5A PRIOR ART
FIG. 5A is a longitudinal cross-sectional view of a prior-art vibrating tool.
Figure 5B:
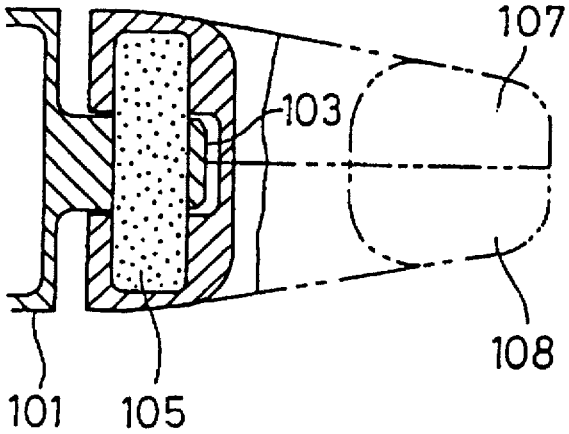
FIG. 5B PRIOR ART
FIG. 5B is a cross-sectional view taken along line 5B—5B in FIG. 5A.
Figure 6A:
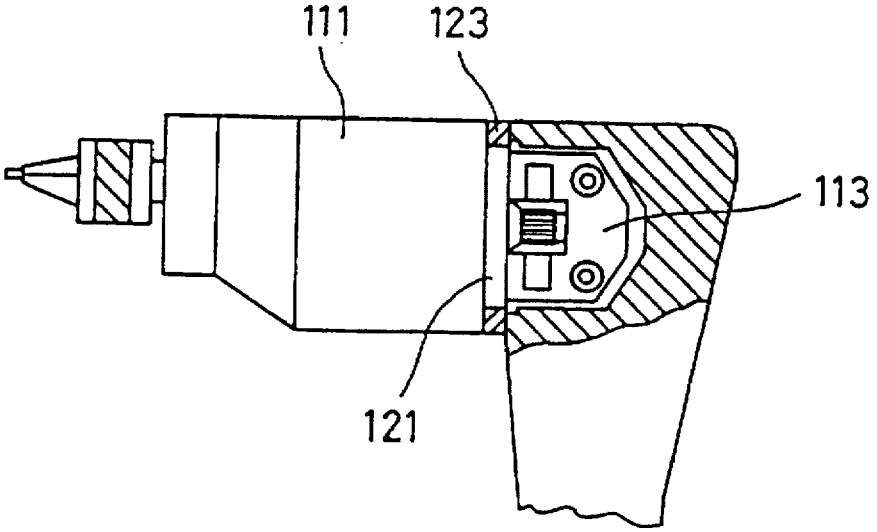
FIG. 6A PRIOR ART
FIG. 6A is a side view, partly taken away, of another prior-art vibrating tool.
Figure 6B:
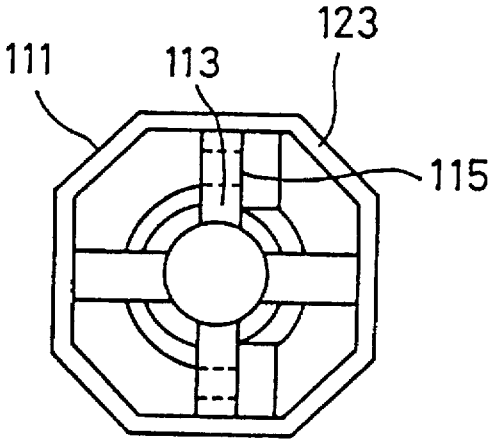
FIG. 6B PRIOR ART
FIG. 6B is a cross-sectional view showing the vibration isolation portion of the vibrating tool and FIG. 6C is an enlarged longitudinal cross-sectional view of a handle-fastening portion of the tool.
Figure 6C:
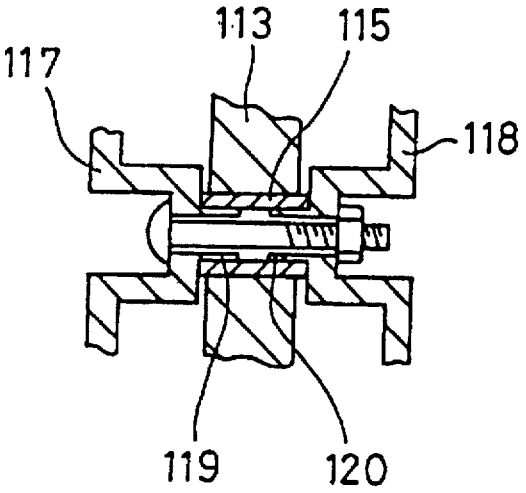
FIG. 6C PRIOR ART

The cross-sectional configuration of the grooves and the hollows in the rubber ring can be U-shaped or circular, as shown in FIGS. 4H and 4I, respectively. As shown in FIGS. 4J and 4K, the groove to be deformed for absorbing vibration can be radially outwardly opened.

As the elastically compressible member, the rubber vibration isolating ring of the invention can be replaced by a ring formed of a thin coil spring, a metal or resin coned disc spring or other suitably elastic member.

The invention is not limited to the vibrating drill of the embodiment, and can be a rock drill, an electric hammer or other vibrating tool. The vibration isolating ring according to the invention can be used individually as a vibration isolating member for use in a conventional vibrating tool.

The invention is not limited to a cylindrical projection 15. The projection 15 could be square. Moreover, there may be three projections extending from the housing with flanges that engage three stops in the handle, as opposed to a single projection and a single stop.

What is claimed is:

1. A vibrating tool having a body housing for housing a drive component, a vibration generating mechanism being incorporated within said housing, and a handle being displaceably interconnected with said housing, said tool comprising:

a projection being supported by a rear wall of said housing adjacent said handle wherein said projection is a cylindrical member which supports a radially outwardly extending flange that extends from an end of said projection remote from said housing, and an open area is defined between the rear wall of said housing and said flange;

said handle comprising first and second handle portions, said first and second handle portions each carrying a stop member for retaining said projection of said housing and thereby interconnecting said handle to said housing;

a clearance being defined between said projection and said stop members of said handle to facilitate displacement, at least in a vibrating direction of said vibrating mechanism, of said housing relative to said handle, during use;

each said stop member supports a radially inwardly extending stop that extends from an end of said handle adjacent said housing, each said stop is displaceably received in said open area, at least in said vibrating direction, and to retain said flange with said clearance provided therebetween; and an elastic compressible member being interposed in said clearance between said projection of said housing and said stop members of said handle for isolating said handle from vibrations generated is said housing by said vibration generating mechanism.

2. The vibrating tool according to claim 1, wherein said elastically compressible member is an annular component mounted around the cylindrical member in said clearance, at least between said stop and the rear wall of said housing.

3. The vibrating tool according to claim 2, wherein said compressible member further comprises a radially outwardly opening annular groove, in an outer peripheral surface of said compressible member, with said stop received in said groove.

4. The vibrating tool according to claim 3, wherein said compressible member further comprises a partially hollow cross-sectional configuration.

5. The vibrating tool according to claim 3, wherein an inner diameter of said compressible member is smaller than an outer diameter of said cylindrical member and a radially inwardly opening annular groove is located in an inner peripheral surface of said compressible member, said inwardly opening groove is sealed by an outer peripheral surface of said cylindrical member.

6. A vibrating tool having a body housing for housing a drive component, a vibration generating mechanism being incorporated within said housing, and a handle being displaceably interconnected with said housing, said tool comprising:

a projection being supported by a rear wall of said housing adjacent said handle;

said handle comprising first and second handle portions, said first and second handle portions each carrying a stop member for retaining said projection of said housing and thereby interconnecting said handle to said housing;

a clearance being defined between said projection and said stop members of said handle to facilitate displacement, at least in a vibrating direction of said vibrating mechanism, of said housing relative to said handle, during use; and said compressible member further having a radially outwardly opening annular groove, in an outer peripheral surface of said compressible member, with said stop received in said outwardly opening annular groove.

7. The vibrating tool according to claim 1, wherein said elastically compressible member further comprises a partially hollow cross-sectional configuration.

8. The vibrating tool according to claim 1, wherein said elastically compressible member further comprises a radially inwardly opening annular groove, in an inner peripheral surface of said compressible member, that is sealed by an outer peripheral surface of said cylindrical member.

9. The vibrating tool according to claim 1, wherein said compressible member further comprises a partially hollow cross-sectional configuration.

10. The vibrating tool according to claim 1, wherein an inner diameter of said compressible member is smaller than an outer diameter of said cylindrical member and a radially inwardly opening annular groove is located in an inner peripheral surface of said compressible member, said inwardly opening groove is sealed by an outer peripheral surface of said cylindrical member.

11. A vibration isolating elastically compressible member, for location between a handle and a tool body housing of a vibrating tool comprising a projection, being supported by a rear wall of said housing;

said projection being a cylindrical member which supports a radially outwardly extending flange that extends from an end of said projection remote from said housing, and an open area is defined between the rear wall of said housing and said flange;

said handle comprising first and second handle portions, said first and second handle portions each carrying a stop member for retaining said projection of said housing and thereby interconnecting said handle to said housing;

a clearance being defined between said projection and said stop members of said handle to facilitate displacement, at least in a vibrating direction of said vibrating mechanism, of said housing relative to said handle, during use; said elastic compressible member being interposed in said clearance between said projection of said housing and said stop members of said handle for isolating said handle from vibrations generated in said housing by said vibrating mechanism, during use;

a compressible elastic annular component being mounted around the projection; and each said stop member supporting a radially inwardly extending stop that extends from an end of said handle adjacent said housing, each said stop being displaceably received in said open area, at least in said vibrating direction, and said stop retaining said flange with said clearance provided between said flange and said stop.

12. The compressible member according to claim 11, wherein said compressible member has a partially hollow cross-sectional configuration.

13. The compressible member according to claim 12, wherein said partially hollow configuration has at least one radially inwardly opening annular groove, in an inner peripheral surface of said compressible member.

14. The compressible member according to claim 13, wherein said compressible member has a radially outwardly opening annular groove, in an outer peripheral surface of said compressible member, with said stop received in said outwardly opening annular groove.

15. The compressible member according to claim 11, wherein an inner diameter of said compressible member is smaller than an outer diameter of said projection and a radially inwardly opening annular groove is located in an inner peripheral surface of said compressible member, said inwardly opening groove is sealed by an outer peripheral surface of said projection.

16. The compressible member according to claim 11, wherein said compressible member has a radially outwardly opening annular groove, in an outer peripheral surface of said compressible member, with said stop received in said groove.

17. The compressible member according to claim 11, wherein said compressible member is formed of sponge rubber.

18. A method of minimizing vibrations in a vibrating tool having a body housing for housing a drive component, a vibration generating mechanism being incorporated within said housing, and a handle being displaceably interconnected with said housing, said method comprising the steps of:

supporting a projection on a rear wall of said housing, said projection being a cylindrical member which supports a radially outwardly extending flange that extends from an end of said projection remote from said housing, and an open area is defined between the rear wall of said housing and said flange, said projection;

forming said handle of first and second handle portions, carrying a stop member, for retaining said projection of said housing and thereby interconnecting said handle to said housing, on each of said first and second handle portions;

defining a clearance between said projection and said stop members of said handle to facilitate displacement, at least in a vibrating direction of said vibrating mechanism, of said housing relative to said handle, during use wherein each said stop member supports a radially inwardly extending stop that extends from an end of said handle adjacent said housing, each said stop is displaceably received in said open area, at least in said vibrating direction, and said stop retains said flange with said clearance provided between said flange and said stop; and interposing an elastic compressible member in said clearance between said projection of said housing and said stop members of said handle for isolating said handle from vibrations generated in said housing by said vibrating mechanism.

19. The compressible member according to claim 14, wherein said compressible member has two said radially inwardly opening annular grooves in said inner peripheral surface of said compressible member, one on each side of said outwardly opening annular groove.

* * * * *

UNITED STATES PATENT AND TRADEMARK OFFICE

CERTIFICATE OF CORRECTION

PATENT NO. : 5,692,574

DATED : December 2, 1997

INVENTOR(S) : Yuichi TERADA

It is certified that error appears in the above-identified patent and that said Letters Patent is hereby corrected as shown below:

Column 7, line 54, replace "generated is" with "generated in".

Column 8, line 26, replace "said compressible member further having" with "a compressible member having".

Signed and Sealed this

Thirtieth Day of June, 1998

*Attest:*

*Attesting Officer*

BRUCE LEHMAN

*Commissioner of Patents and Trademarks*